US005997448A

United States Patent [19]

Duba

[11] Patent Number: 5,997,448

[45] Date of Patent: Dec. 7, 1999

[54] PHYSICAL EXERCISING STATION

[76] Inventor: Alex Duba, P.O. Box 549, Lake City, Colo. 81235

[21] Appl. No.: 09/096,866

[22] Filed: Jun. 11, 1998

[51] Int. Cl.[6] ..... A63B 21/04

[52] U.S. Cl. ..... 482/121; 482/148; 482/122

[58] Field of Search ..... 211/205, 86.01; 248/354.1, 200.1, 125.1; 482/121–30

[56] References Cited

U.S. PATENT DOCUMENTS

| | | | |
|---|---|---|---|
| 2,919,134 | 12/1959 | Zuro | 482/121 |
| 3,989,241 | 11/1976 | Ourgant . | |
| 4,373,716 | 2/1983 | Pagani | 482/121 |
| 4,685,670 | 8/1987 | Zinkin . | |
| 5,013,035 | 5/1991 | Nathaniel | 482/121 |
| 5,176,602 | 1/1993 | Roberts . | |
| 5,178,591 | 1/1993 | Lyons | 482/52 |
| 5,290,209 | 3/1994 | Wilkinson | 482/38 |
| 5,320,591 | 6/1994 | Harmon et al. . | |
| 5,352,174 | 10/1994 | Mason et al. . | |
| 5,536,229 | 7/1996 | Albergo | 482/121 |

*Primary Examiner*—Jerome Donnelly
*Attorney, Agent, or Firm*—Richard W. Hanes

[57] ABSTRACT

Physical exercising apparatus comprising, a rigid column having first and second ends and adapted to be positioned vertically between the ceiling and floor of a room, a top plate attached to the first end of the column and disposed perpendicularly to the column for contact with the ceiling, a bottom plate disposed at the second end of the column perpendicularly to the column for contact with the floor, a cam lever interconnecting the second end of the column and the bottom plate for moving the column longitudinally with respect to the bottom plate and locking it in a longitudinal position, a horizontally disposed bar, slidable vertically on the column, for supporting an anchored end of at least one resistive exercise band, a projecting handle slidably mounted on the bar for anchoring the end of the elastic band and a rod attached to the outside end of the bar so that the longitudinal axis of the rod is spaced from the longitudinal axis of the bar and perpendicular thereto so that the elastic band may be trained around the rod to change the direction of force applied to the resistive band.

11 Claims, 6 Drawing Sheets

PHYSICAL EXERCISING STATION

The present invention relates to physical training and exercise equipment and more specifically, to a portable exercise station that can be erected and stabilized between the floor and a traditional eight foot ceiling of a room in a house.

BACKGROUND OF THE INVENTION

A large variety of physical exercising devices are available to build and maintain body muscle condition, as well as to provide aerobic exercise for the heart and pulmonary functions of the body. Some of these systems are as simple as bar bells. Others incorporate complex hydraulic or pneumatic devices that operate through gears, ropes, cables and pulleys. These machines are costly and occupy significant floor space and are too heavy to move out of the way. Most machines do not work all of the body muscle groups and many exercise only one side of the body at a time.

Accordingly, it is the primary object of the present invention to provide a simple, low cost exercising station that can be easily and quickly erected in a traditional eight foot ceiling room, using the ceiling and the floor of the room as the anchors for stabilizing the device.

A second object of the invention is to provide exercising apparatus that expands the range of use of the elastic band resistive exerciser device to exercise all of the muscle groups more efficiently, including the exercise of both sides of the body at one time.

The most pertinent example of prior art is found in U.S. Pat. No. 3,989,241 to Ourgant. This patent discloses exercise apparatus comprising a vertical column that supports a fixed hanger and a swing-bar that can rotate through 360°. The user moves the swing-bar in rotation in opposition to the forces provided by resilient elements which interconnect the horizontal hanger and the swing-bar.

It is therefore, another object of the present invention to improve on the general type of device disclosed in the Ourgant patent by providing an exercise station that enlarges on the range of exercising routines that are available with an elastic resistive exerciser element and by further simplifying the structure of the exercising apparatus.

Other and further objects, features and advantages of the present invention will become apparent upon a reading of the following detailed description of a preferred form of the invention, taken in conjunction with the accompanying drawings.

DETAILED DESCRIPTION

Figure 1:
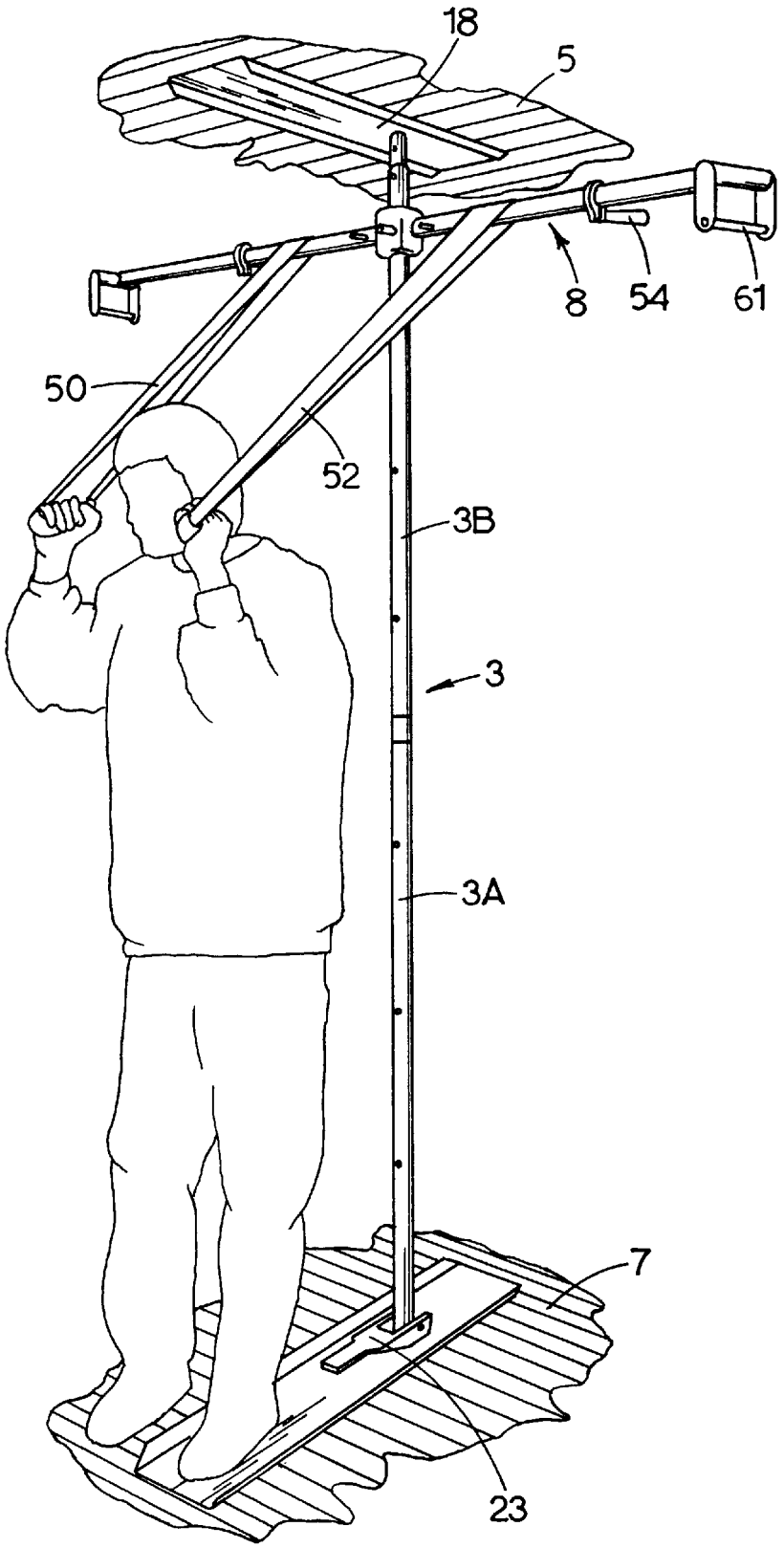
FIG. 1 is a perspective view of the exercising station of the present invention, fragmentarily showing the ceiling and the floor of a room, between which the apparatus is erected and anchored. A user of the device is shown pulling on a pair of resistive elements.
Figure 4:
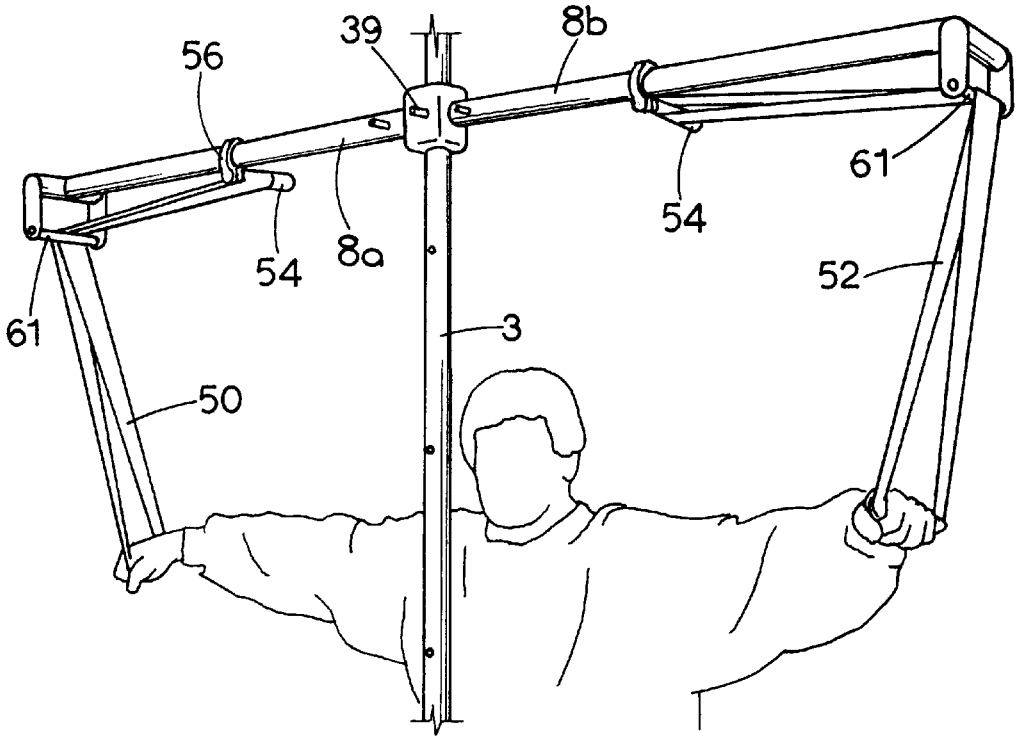
FIG. 4 is a fragmentary view of the exercising device, showing horizontally disposed bars attached to a vertical column at a position above the head of a typical user, also fragmentarily shown.
Figure 5:
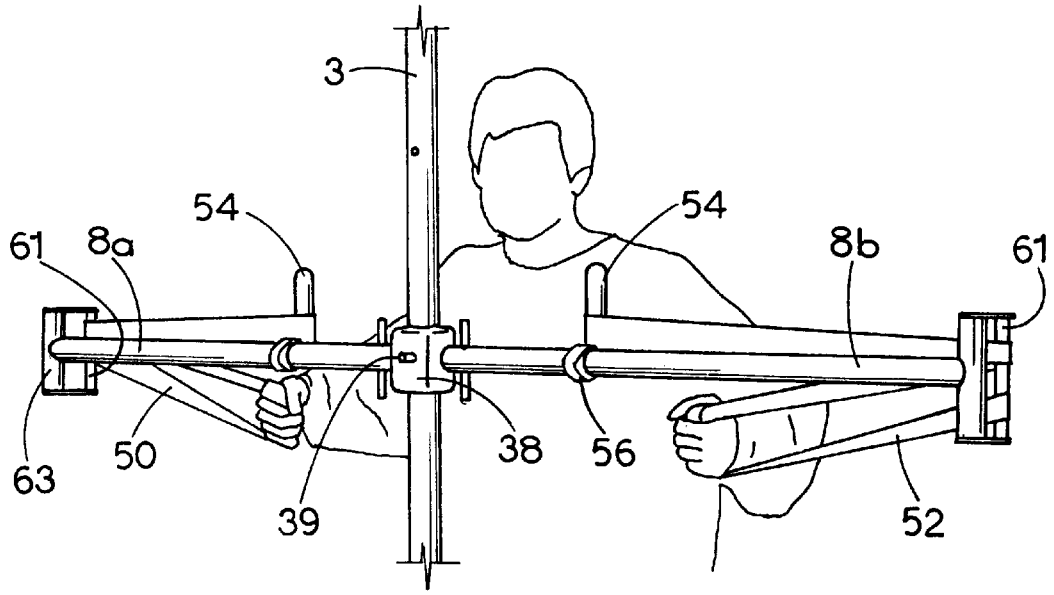
FIG. 5 is a view similar to that of FIG. 4, except the horizontal bars are positioned on the vertical column at a position opposite to the chest of the user. The horizontal bars are also shown rotated 90° from the position shown in FIG. 4.
Figure 9:
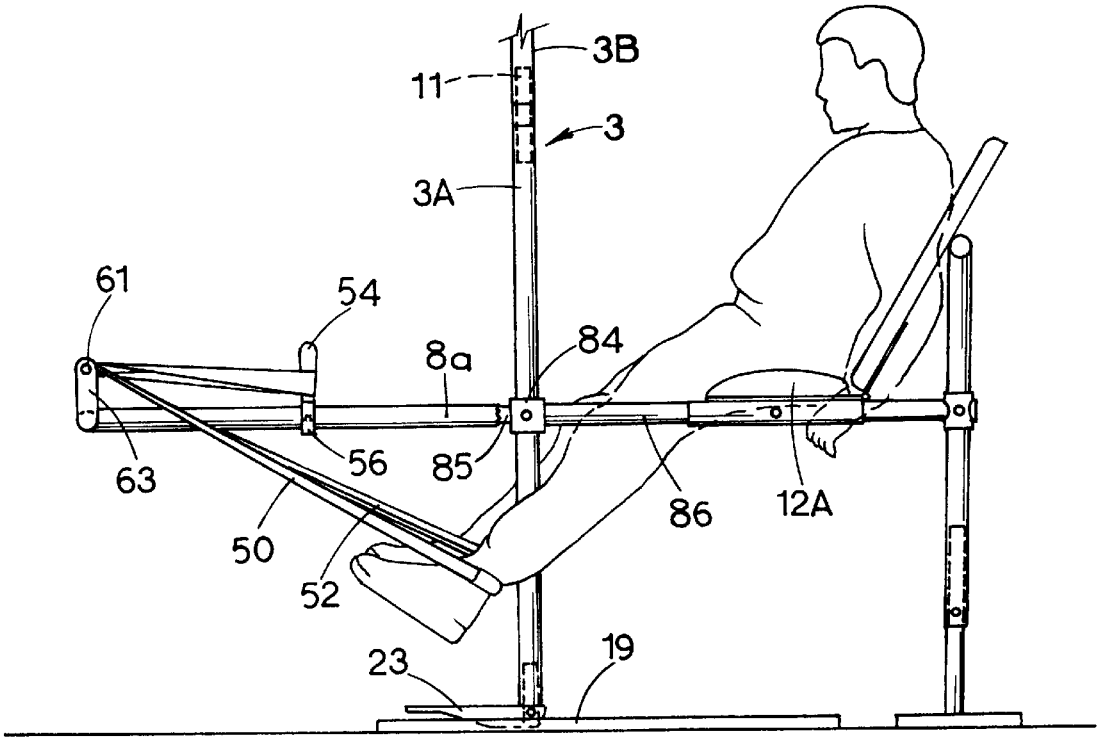
FIG. 9 is a fragmentary side elevational view of the lower portion of the vertical column showing an alternative seat construction and an arrangement of parts whereby one of the horizontal bars is used as a longitudinal extension of the horizontal seat boom to provide mooring for the resistive elements for exercising leg muscles while seated in the chair.

Generally, a vertically adjustable two piece column 3 is firmly anchored in position between the ceiling 5 and the floor 7 of a traditional eight foot ceiling room. A horizontal bar 8 is slidably adjustable up and down on the column 3 so that it can be anchored in any desired vertical position. The function of the horizontal bar 8 is to provide a mooring for one or more elastic exercising bands, such as, for example, the Dyna-Band® Resistive Exerciser made by Gilliam Enterprises, Inc. of Hudson, Ohio or pieces of surgical tubing. Elongated pieces of vehicle tire inner tubes would also serve the purpose, as well as other similar elastic elements. The elastic bands may be attached to the horizontal bar 8 is a variety of ways, as shown in FIGS. 1, 4 and 5, to achieve different kinds of exercise for each different type of attachment. In addition to the exercise variations related to mooring the elastic band/s to the horizontal bar, additional routines are possible by changing the vertical position of the bar. As shown in FIG. 9, the horizontal bar may be positioned near the height of the seat 12 and the elastic exerciser bands can then be used to exercise muscle groups in the legs. In addition to the use of one of the horizontal bars to extend the seating boom 75, the entire horizontal bar may be lowered to a position that will be at right angles to the extended boom bar shown in FIG. 9.

For compact storage purposes, the vertical column 3 is preferably comprised of two circular tubes 3A and 3B which, when assembled as shown in FIG. 1, are held together by a stub shaft 11. The stub shaft is welded to the lower tube 3A and press fit into the interior of upper tube 3B.

In assembling the unit, the top end of the upper tube 3B of the column 3 is slipped over a stub shaft 13 that is perpendicularly attached to the lower surface of an elongated ceiling plate 18. Preferably, the plate 18 is provided with a non-skid rubber pad over the ceiling-contacting surface thereof. The stub shaft 13 is provided with a plurality of diametrically opposed holes 14 for receiving a pin 15 which is inserted in diametrically opposed holes in the top of the column section 3B. During erection of the vertical column 3 between the floor and ceiling, the stub shaft 13 is adjusted and positioned with the pin 15 so as to come as close as possible to matching the distance between the floor and ceiling. Even though the traditional ceiling is eight feet from the floor, variations do occur and the adjustable stub shaft 13 is sufficient to accommodate those variations within a small tolerance. That tolerance is taken up to create a tight fit between the floor and ceiling by a further adjustment and locking mechanism at the floor level, as will be explained.

The bottom end of the column is equipped with means for raising the column to eliminate whatever space is present between the ceiling the ceiling plate after making the best adjustment of the interconnection between the ceiling stub shaft 13 and the top of the column section 3B, as described above. The ceiling plate is pressed against the ceiling by stepping on a cam lever 23 to raise and stabilize the column by anchoring it firmly in place between the ceiling and the floor.

Figure 8A:
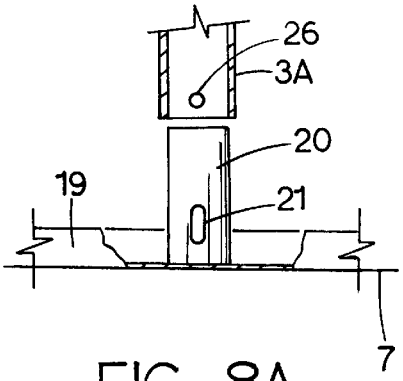
FIG. 8A is a fragmentary cross sectional view of the bottom portion of the vertical column disposed just above a stub shaft on the floor plate. The position of the respective parts in this view is representative of the initial step of assembly of the vertical column with the floor plate, just prior to telescoping the vertical column down over the floor plate's stub shaft.
Figure 8B:
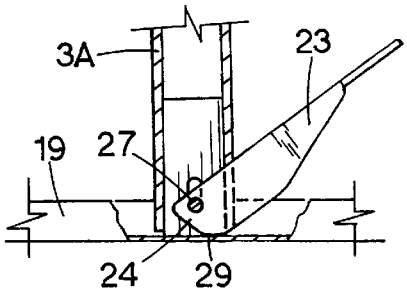
FIG. 8B is a fragmentary cross sectional view of the bottom portion of the vertical column and showing a pin interconnecting the column, the floor plate stub shaft and a cam lever, prior to raising the vertical column.
Figure 8C:
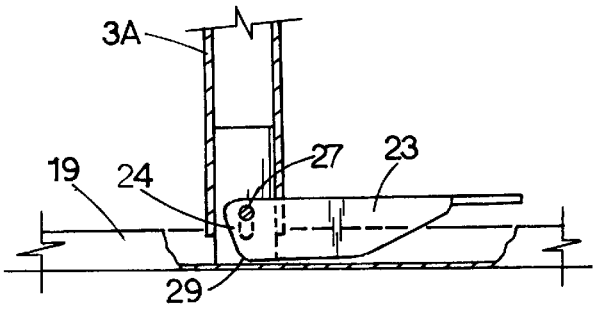
FIG. 8C is a fragmentary cross sectional view of the bottom portion of the vertical column after the cam lever has been pressed downwardly so as to raise the vertical column with respect to the floor plate and the attached stub shaft.

Referring to FIG. 8A, an elongated floor plate 19 is provided with a perpendicular stub shaft 20 that is insertable into the hollow interior of the lower end of section 3A of the vertical column 3. The floor plate 19 is preferably provided with a non-skid rubber pad over the surface of the plate that contacts the floor. The lower end of the column is provided with diametrically opposed apertures 26. The stub shaft contains diametrically opposed vertically oriented slots 21 to accommodate a fastening pin 27. After the column is lowered onto the stub shaft, during assembly of the unit, the pin 27 is inserted through apertures in the spaced apart ears 24 and 25 of the cam lever 23, through the column apertures 26 and the stub shaft slots 21, as shown in FIG. 8B. The bottom profile 29 of each of the cam lever cars is cam shaped. As the lever 23 is pressed downwardly toward the floor plate 19 the curved contact between the bottom profile 29 and the upper surface of the floor plate creates an upward force on the column 3, through the fastening pin 27. As the lever continues to be pushed toward the floor plate, the rounded corner of the cam profile 29 passes out of contact with the plate 19 and the flat portions of the ears' cam surfaces come into contact with the surface of the floor plate, as shown in FIG. 8C. The vertical column 3 is locked into the raised position by this over the center cam action of the cam lever 23, creating a tight fit between the ceiling plate 18 and the ceiling 5 and the floor plate 19 and the floor 7, thus anchoring the vertical column 3 in place. A lifting force on the cam lever 23 is required to release the compressive force between the floor and ceiling, permitting removal of pins 15 and 27 and allowing the column 3 to be tilted and disassembled or moved to another location.

It should be noted that the compressive force created in the column 3 by the camming action of the cam lever 23 does not alone maintain the column in place between the ceiling and the floor during high force lateral pulls on the column by the intended use of the apparatus. By the use of ceiling and floor plates, the area of ceiling and floor contact is enlarged over what it would be if the ends of the column 3 were in contact with the ceiling and the floor. This enlarged area and especially the elongation of the plates in the direction of force application to the device, creates a greater force moment against the ceiling and floor than would be present without the plates or if the plates were short with respect to the column diameter. This force moment in both the ceiling and floor plates is created when an unbalanced lateral force is applied to the column, as would be done during use of the device for its intended purpose. The couple of force moments are respectively applied to the ceiling and floor at the toe end of the ceiling plate and at the heel end of the floor plate, creating a wedging action that maintains the column in place. Furthermore, providing the plates with a large surface area distributes the moment forces over a greater area, thus reducing the pressure on the ceiling and floor so as not to mar the surfaces thereof. It may be said that the larger the plates, the better. However practicality dictates a limit. Preferably the plates should have a width of not less than three times the diameter of the column 3 and a length from toe to heel, along the axis of force application, of not less than one tenth of the straight-line distance between the toe of the ceiling plate and the heel of the floor plate.

The horizontal bar 8 is preferably comprised of two bar portions 8*a* and 8*b*. These bar portions are carried by a collar 38 that slides up and down the tubular column 3. The collar 38 is anchored to a selected position on the column by any one of a number of methods, such as a set screw or a pin. The preferred form of the invention utilizes a pin 39 which projects through opposing holes in the collar and through aligned, diametrically opposed holes in the sides of the tubular column 3. A plurality of holes for this purpose are placed in the column up and down its entire length in order that the collar and the bar 8 can be positioned at any desired level.

Figure 6:
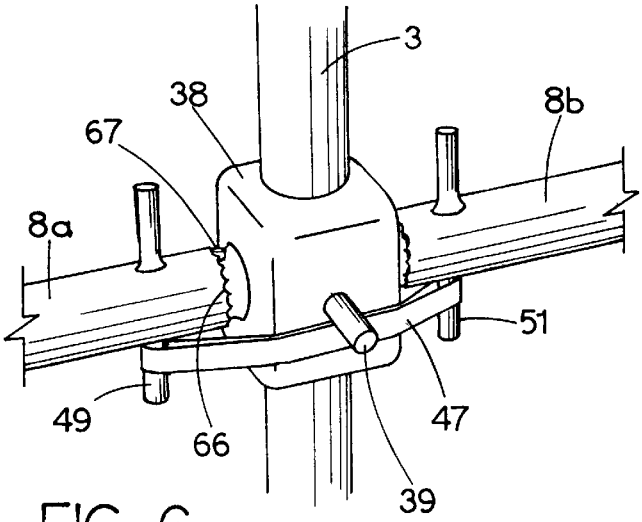
FIG. 6 is an enlarged fragmentary perspective view of the collar which supports the horizontal bars on the vertical column and which is adapted to slide up and down on the vertical column for selective adjustment of the vertical position of the horizontal bars.

Welded, or otherwise attached, to the opposing sides of the collar 38 are a pair of longitudinally aligned cantilever beams 43 and 45. These beams are sized and dimensioned to fit snugly into the interior of the tubular bars 8*a* and 8*b* so as to support the bars in cantilever fashion. In operation, since there is no outwardly directed longitudinal force on either of the bars 8*a* or 8*b*, there is little tendency for the bars to work off of their supporting beams 43 and 45. Nevertheless, a strong rubber band or similar device may be employed to constantly bias the bars toward the column. The rubber band 47 is looped around studs 49 and 51 attached to and perpendicularly extending from the proximal ends of the bars 8*a* and 8*b*, as shown in FIG. 6. The tension of the rubber band 47 keeps the bars 8*a* and 8*b* in the proper position on the cantilever beams.

The great utility of the described device is its multitude of different exercise uses. FIGS. 1, 4, 5 and 9 illustrate only four of the many different configurations which are possible and which permit a wide variety of exercises. Exercise is achieved through the resistive force supplied by one or two elongated narrow sheets of elastic material formed in a loop, such as the elements 50 and 52. The resistive elements can be, for example, the Dyna-Band® resistive exerciser. In the configuration of FIG. 1 the two resistive elements are looped around the bar sections 8*a* and 8*b*, which sections are positioned at a height above the head of a standing user. By holding the unanchored ends of the elements 50 and 52 and flexing the forearms against the resistance of the elastic elements, the triceps muscles of the arms are developed. Resistance may be adjusted by changing the user's position with respect to the column 3 and/or changing the vertical position of the horizontal crossbars 8*a* and 8*b*.

Figure 7:
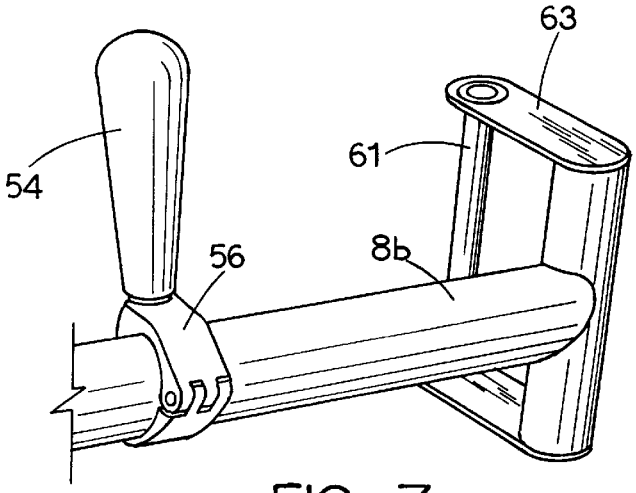
FIG. 7 is an enlarged fragmentary perspective view of the distal end of one of the horizontal bars, showing an anchor, or handle, for mooring one end of the resistive exerciser band. The handle is slidable on the bar for selective positioning thereon. This view also illustrates an end bar around which the elastic band may be trained to change the direction of force that may be applied to it.

Standing under the raised bar 8, as illustrated in FIG. 4, the user can raise and lower his/her arms against the resistive force of the elastic elements to exercise and develop the latismos dorsi, or "lats" of the back. In this configuration the resistive elements 50 and 52 are anchored by looping the closed end of each element around a laterally extending handle 54, which is also shown in FIG. 7. The handles 54 are slidably mounted respectively on the bar sections 8*a* and 8*b* so that the desired amount of tension can be supplied by the resistive elastic elements. The handles 54 are secured in a selected position on the bars by tightening the respective clamps 56 in a manner well known in the art. After anchoring the ends of the resistive elements on the handles 54 at the respective desired positions along the bar sections each of the resistive elements is passed around a rod 61 mounted at the end of each of each of the bars. A "U" shaped bracket 63 that is welded, or otherwise attached to the end of the bar section supports each of the rods 61. The rods 61 provide support and a change of direction for the elastic members that are trained around them. The rods 61 may be fixed or they may be rotatable on an inner roller bearing. In the configuration of FIG. 4, the rods 61 are positioned so that they are parallel to the floor and ceiling.

FIG. 5 illustrates the configuration of the exercising device for development of the pectoral muscles of the chest. For this exercise the bar 8 is lowered to chest height by unlocking and sliding the bar supporting collar 38 down the column 3 and locking it into a new selected position. For this exercise it is desirable to have the rods 61 perpendicular to the floor and ceiling, as shown in FIG. 5. In order to change the position of the rods 61, the bar section on which the rod bracket 63 is mounted must be rotated. FIG. 6 shows that the distal end of each of the bar sections 8*a* and 8*b* is scalloped around its circumference. Each of the scalloped sections 66 is adapted to engage the curved surface of a cylindrical stud 67 protruding from the cantilever bar that supports the bar section. By pulling against or completely releasing the tension force of the rubber band 47 the bar section may be slid outwardly from the column a small distance and rotated so that the associated rod 61 mounted thereon may be position as desired. When the desired rotation is achieved to properly position the rod 61, the bar is slid inwardly toward the collar 38 and the stud 67 comes into contact with another scalloped section of the bar's circumferential inner end. If the rubber band 47 was unhooked to make the bar rotation, it is reattached to maintain the tension and pull the bar sections together, keeping the stud 67 in the selected one of the scalloped indexing cut-outs in the end of the bar section.

Figure 2:
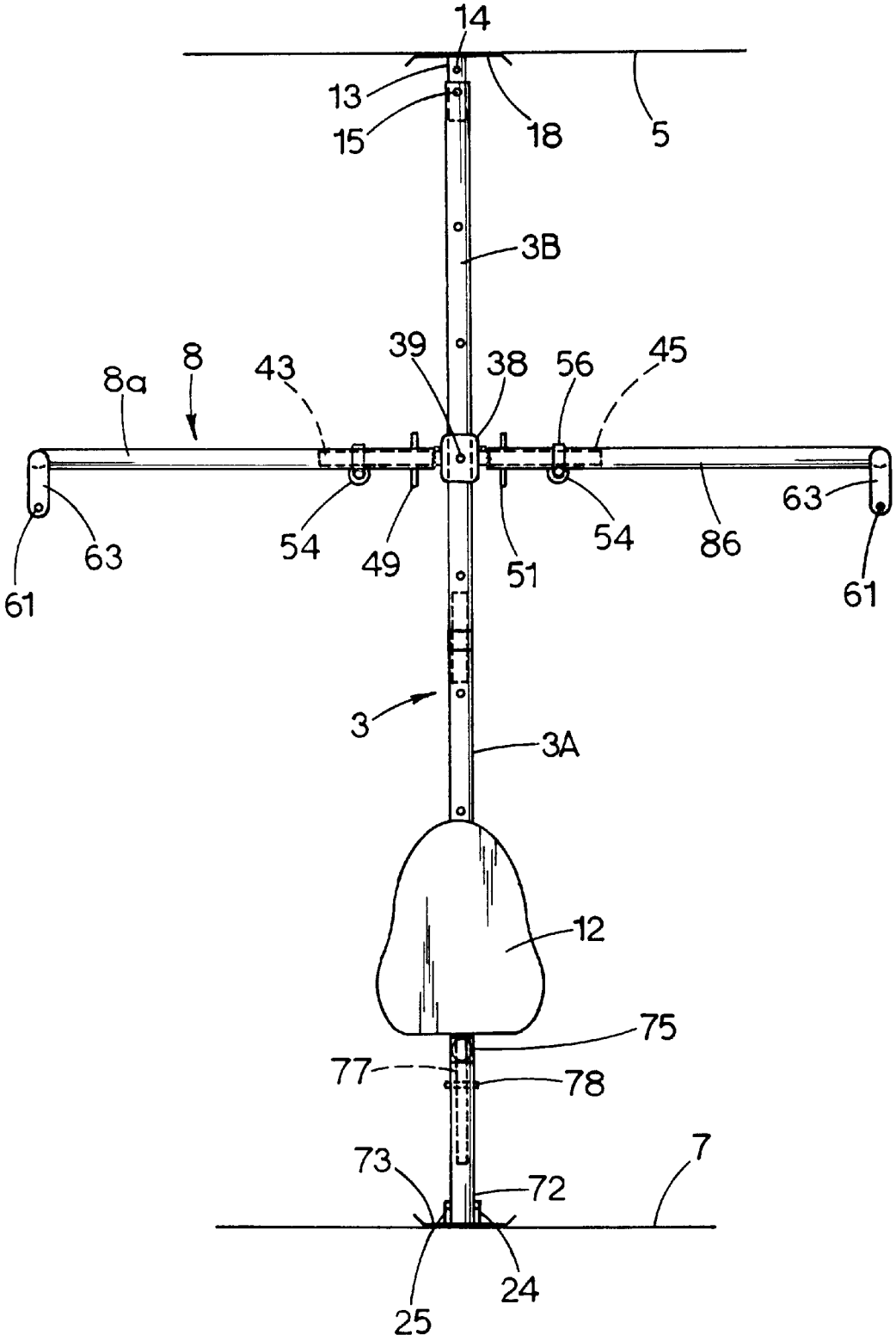
FIG. 2 is a front elevational view of the exercising apparatus, as installed between the ceiling and floor of a room. This view includes a seat, which is not attached to the device shown in FIG. 1.
Figure 3:
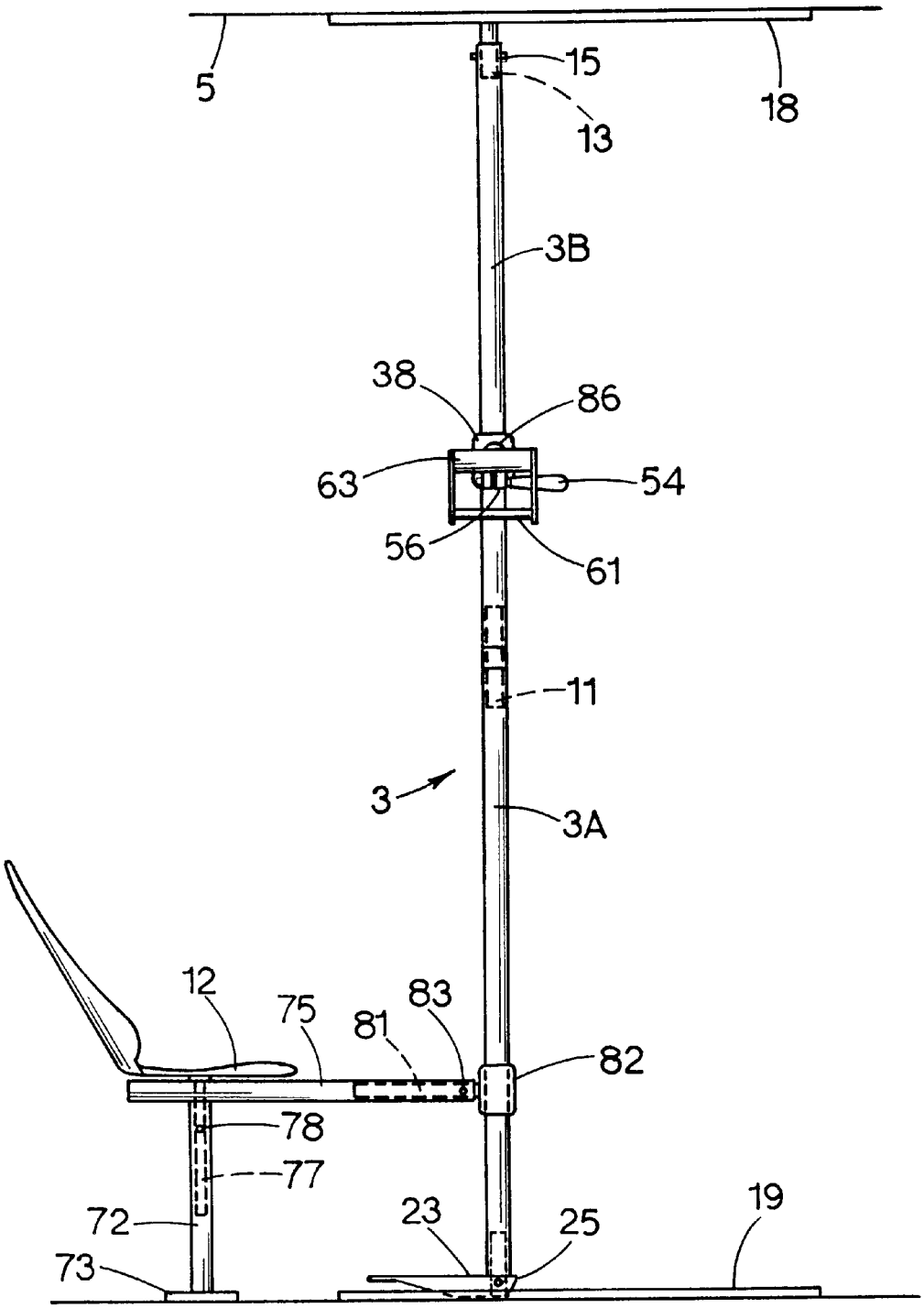
FIG. 3 is a side elevational view of the device shown in FIG. 2.

For exercises involving the lower body and legs the bar 8 may be lowered to a position at, above or below the level of the seat 12. The seat itself may be of several different configurations. It is supported by a vertical post 72 attached to a horizontal floor plate 73, as shown in FIGS. 2, 3 and 9. The seat is attached to the main vertical column 3 by a horizontally disposed connecting boom 75. The height of the seat may be adjusted by raising or lowering a telescoping shaft 77 which slides inside the supporting post 72 and may be anchored by a pin 78 which penetrates the post 72 and the shaft 77. The seat's distance from the column 3 may be adjusted in a manner similar to the seat's height adjustment. A horizontal spacing shaft 81 is rigidly fixed to a collar 82 that surrounds the lower portion of the column 3. The connecting boom 75 is slidably mounted in telescoping fashion on the horizontal spacing shaft 81 and is locked on the shaft 81 by a pin 83 which is placed in a selected one of a plurality of opposed diametrically disposed holes in the cylindrical tubing of the boom 75. The pin also projects through diametrically opposed holes in the spacing shaft 81 to lock the spacing shaft and the boom together in a selected position. While seated on the seat 12, the user's feet can be placed in the loops of the elastic members 50 and 52 to exercise any muscles of both legs at the same time.

FIG. 9 illustrates an alternative embodiment of the seating arrangement. A seat 12A is supported by a horizontal beam and a vertical support, similar to the arrangement shown in FIGS. 2 and 3. A collar 84, similar in construction to the first described collar 38, supports the inner end of the horizontal seat-supporting boom 86. Diametrically disposed to the seat boom 86 and also sustained by the collar 84 is a cantilever beam 85, similar in purpose and construction to the cantilever beam 43 that is borne by the collar 38. For particular leg muscle exercises, one of the horizontal bars 8A is slipped onto the cantilever beam 85, as shown in FIG. 9. The handle 54 and the bracket 63 are positioned so as to hold one or two of the resistive elements 50 and 52. The elastic bands may be placed around the ankles or lower legs for exercising the leg muscles. The seat 12A is attached to the supporting boom 86 by a removable pin, or similar fastening, allowing the seat to be rotated 180° from the position shown in FIG. 9. In this position the seat back would recline against the column 3A. The reverse position of the seat allows the user to exercise an opposite set of leg muscles from those exercised in the forward position, shown in FIG. 9.

I claim:

1. Physical exercising apparatus comprising, a rigid column having first and second ends and adapted to be positioned vertically between parallel planes that comprise the ceiling and floor of a room, a top plate attached to the first end of the column and disposed perpendicularly to the column for contact with the ceiling, a bottom plate disposed at the second end of the column perpendicularly to the column for contact with the floor, cam means interconnecting the second end of the column and the bottom plate for moving the column longitudinally with respect to the bottom plate and locking it in a longitudinal position, a bar slidably supported by the column for mooring resilient exercise elements, a rod attached to the end of the bar so the longitudinal axis of the rod is spaced from the longitudinal axis of the bar and perpendicular thereto.

2. The combination of claim 1 where the bar comprises two hollow aligned and opposed portions, each carried by the column.

3. The combination of claim 2 and further including, attachment means for interconnecting the column and the bar, including, a collar slidable on the column, a pair of aligned laterally projecting cantilever beams attached to the collar, adapted and sized to fit within the hollow interior of the respective bar portions for support thereof.

4. The combination of claim 3 and further including, indexing means carried by the said beams for interacting with the bar portions to fix the rotative position of each of the bar portions with respect to the respective beams.

5. The combination of claim 4 and further including, anchor means slidably mounted on each of the bar portions for securing a resilient exercise element.

6. The combination of claim 1 and further including, a seat, means for supporting said seat on the floor, including an adjustable length connecting beam slidably attached to the column.

7. Physical exercising apparatus comprising, a vertical column, a sleeve slidably supported by the column such as to be adjustable in height, at least one horizontally cantilevered bar carried by the sleeve, means carried by the bar for mooring an elastic band including, a projecting handle slidably mounted on the bar, and a rod mounted on the bar perpendicularly thereto.

8. The apparatus of claim 7 and further comprising, means for anchoring the vertical column between two parallel planes, including, a plate having a perpendicularly disposed stud projecting therefrom and adapted to telescopically mate with the vertical column, a cam lever pivotally attached to the vertical column and the said stud and disposed in contact with the plate.

9. The combination of claim 8 and further comprising, a seat, a vertical post supporting the seat, a horizontal beam attached to the vertical column and to the vertical post.

10. The combination of claim 9 and further including, a cantilever beam coaxial with the horizontal beam and carried by the vertical column.

11. Physical exercising apparatus comprising, a vertical column having upper and lower ends, a sleeve slidably supported by the column such as to be adjustable in height, at least one horizontally cantilevered bar carried by the sleeve, means carried by the bar for mooring at least one elastic resistive element, an elongated ceiling plate, having a length terminable in a toe and heel portion, perpendicularly attached to the upper end of the vertical column, an elongated floor plate, having a length terminable in a toe and heel portion, perpendicularly attached to the lower end of the vertical column, wherein the length of the plates is not less than one tenth of the straight line distance between the toe of the ceiling plate and the heel of the floor plate.

* * * * *